US007070136B1

(12) United States Patent
Bailey

(10) Patent No.: US 7,070,136 B1
(45) Date of Patent: Jul. 4, 2006

(54) FENCE ASSEMBLY

(76) Inventor: Richard D. Bailey, Rt. 2 Box 194, Noel, MO (US) 64854

( * ) Notice: Subject to any disclaimer, the term of this patent is extended or adjusted under 35 U.S.C. 154(b) by 117 days.

(21) Appl. No.: 10/666,326

(22) Filed: Sep. 19, 2003

(51) Int. Cl.
*B02C 19/12* (2006.01)

(52) U.S. Cl. ..... 241/260.1; 241/277

(58) Field of Classification Search ..... 241/260.1, 241/278.1, 277; 256/1, 31, 32, 35, 36, 63, 256/64, DIG. 5
See application file for complete search history.

(56) References Cited

U.S. PATENT DOCUMENTS

| | | | | | |
|---|---|---|---|---|---|
| 282,039 | A | * | 7/1883 | Beckwith | 256/32 |
| 357,745 | A | | 2/1887 | Van Horn | 256/68 |
| 619,684 | A | * | 2/1899 | Emerton et al. | 256/35 |
| 1,330,808 | A | | 2/1920 | James | 52/150 |
| 1,981,447 | A | | 11/1934 | Clark | 52/150 |
| 2,445,545 | A | | 7/1948 | Verner | 256/35 |
| 2,690,326 | A | | 9/1954 | Kranick | 256/21 |
| 3,092,407 | A | | 6/1963 | Blonder | 403/191 |
| 4,398,840 | A | | 8/1983 | French | 403/98 |
| 4,682,761 | A | | 7/1987 | Hanneken | 256/36 |
| 5,061,109 | A | | 10/1991 | Miller | 403/36 |
| 5,104,074 | A | | 4/1992 | Malloy | 248/156 |
| 5,460,344 | A | | 10/1995 | Malloy | 248/156 |
| 5,593,143 | A | | 1/1997 | Ferrarin | 256/68 |
| 6,705,598 | B1 | * | 3/2004 | Collins | 256/35 |

* cited by examiner

*Primary Examiner*—Daniel P. Stodola
*Assistant Examiner*—Michael P. Ferguson
(74) *Attorney, Agent, or Firm*—William R. Sharp

(57) ABSTRACT

A fence assembly is provided which comprises: a first fence post extending upwardly from the ground; a first tubular member having a first upper end and a first lower end, the first tubular member being received over but not connected to the first fence post such that the first lower end rests upon the ground; a first lug laterally extending from the first tubular member; a second fence post extending upwardly from the ground; a second tubular member having a second upper end and a second lower end, the second tubular member being received over but not connected to the second fence post such that the second lower end rests upon the ground; a second lug laterally extending from the second tubular member; a brace having opposing ends; a first connection means for removably connecting one end of the brace to the first lug; and a second connection means for removably connecting the other end of the brace to the second lug. According to another aspect of the invention, a combination of a tubular member and pairs of fixed and rotatable sleeves with lugs extending therefrom can be received over a fence post for use in numerous possible fencing configurations.

14 Claims, 3 Drawing Sheets

FENCE ASSEMBLY

BACKGROUND OF THE INVENTION

The invention relates to a fence assembly employing tubular members received over fence posts (i.e. T-posts) and braces removably connected to and between pairs of tubular members.

Standard fencing for farms and ranches uses metal T-posts that are driven into the ground, and barbed wire stretched between the T-posts. However, certain posts for this type of fence, such as corner posts or gate posts, must provide extra strength and stability. These posts are typically large in diameter (i.e. 6 inches), and require an appropriate sized post hole that is dug to a depth sufficient to provide the necessary stability. Cement is sometimes poured in the hole around the post. Consequently, installation of such posts is a time consuming and labor intensive operation.

SUMMARY OF THE INVENTION

According to one aspect of the invention there is provided a fence assembly comprising: a first fence post extending upwardly from the ground; a first tubular member having a first upper end and a first lower end, the first tubular member being received over but not connected to the first fence post such that the first lower end rests upon the ground; a first lug laterally extending from the first tubular member; a second fence post extending upwardly from the ground; a second tubular member having a second upper end and a second lower end, the second tubular member being received over but not connected to the second fence post such that the second lower end rests upon the ground; a second lug laterally extending from the second tubular member; a brace having opposing ends; a first connection means for removably connecting one end of the brace to the first lug; and a second connection means for removably connecting the other end of the brace to the second lug.

In a preferred embodiment hereafter described, each fence post is a T-post driven into the ground in the usual manner, the second tubular member is shorter in length than the first tubular member, and a second brace is removably connected between additional lugs on the tubular members. Most preferably, third and fourth braces are connected between the first tubular member and a third tubular member that is similar to the second tubular member. The first tubular member, as received over the first fence post and braced as described, can serve as a corner post, gate post, or in other applications described further below.

Assembly of the various components is quick and easy. No time consuming post hole digging is required, and common bolts and nuts can be employed to connect the ends of the braces to respective lugs. In accordance with the preferred embodiment, a connector at each end of a brace is longitudinally adjustable and allows for a pivotal connection between the connector and a lug, thereby making the fence assembly even more user friendly, particularly when installed on uneven terrain.

According to another aspect of the invention, there is provided a combination comprising: a tubular member having a longitudinal axis and opposing first and second ends; a first sleeve rotatably connected to the tubular member so as to be rotatable about but not movable along the longitudinal axis, the first sleeve being more closely adjacent to the first end than the second end; a pair of transversely opposed and apertured first lugs integrally connected to and laterally extending from the first sleeve; a second sleeve rotatably connected to the tubular member so as to be rotatable about but not movable along the longitudinal axis, the second sleeve being more closely adjacent to the second end than the first end; a pair of transversely opposed and apertured second lugs integrally connected to and laterally extending from the second sleeve; a pair of transversely opposed and apertured third lugs integrally connected to and laterally extending from the tubular member adjacent to the first sleeve and associated first lugs, the third lugs thereby also being more closely adjacent to the first end than the second end; and a pair of transversely opposed and apertured fourth lugs integrally connected to and laterally extending from the tubular member adjacent to the second sleeve and associated second lugs, the fourth lugs thereby also being more closely adjacent to the second end than the first end.

The above-mentioned tubular member, as received over a standard fence post (i.e. T-post), can serve as a corner post, gate post, etc. in the manner previously described. The apertured lugs can receive bolts or other fasteners therethrough for connecting braces to the lugs. The two pairs of transversely opposed lugs near each end of the tubular member allow for connection of some or all of the lugs to corresponding braces in the assembly of almost any fencing configuration. Finally, the rotatable sleeves and associated lugs permit adjustment of the angular relationship between such lugs and those lugs integrally connected to the tubular member, and thereby also between braces connected to corresponding lugs.

DESCRIPTION OF A PREFERRED EMBODIMENT some terms, as used in the following description and in the appended claims, will now be defined.

A "T-post" is defined as a fence post having elongated perpendicular legs and a transverse T-shaped cross section.

With regard to "integrally connected" members, this means that the members are fixedly connected to one another (i.e. by welding) or are integral with one another.

The term "apertured" as applied to any member (i.e. lug or connector) means that the member has at least one aperture.

Figure 1:
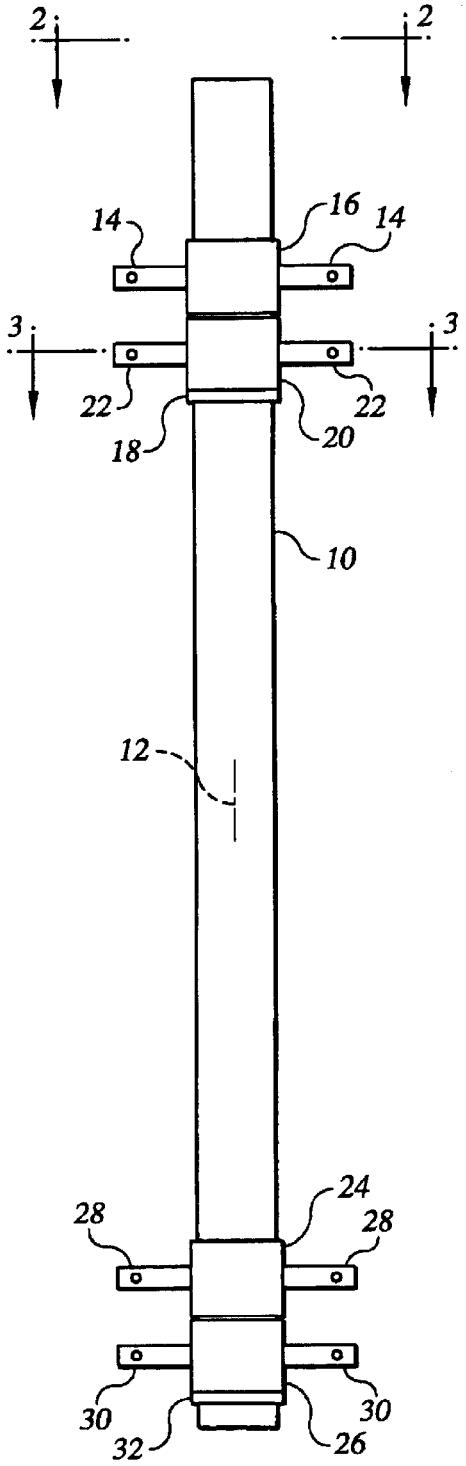
FIG. 1 is a side view of a tubular member having sleeves rotatably and integrally connected thereto, with pairs of lugs integrally connected to respective sleeves.

Referring to FIG. 1, tubular member 10 has a longitudinal axis 12 and opposing upper and lower ends which are open. A pair of transversely opposed and apertured lugs 14 are integrally connected to and laterally extend from a sleeve 16, which is integrally connected to tubular 10. Therefore, lugs 14 are integrally connected to and laterally extend from tubular member 10 by means of sleeve 16. Ring 18 is also integrally connected to tubular member 10. A sleeve 20 is rotatably connected to tubular member 10, and is closely received between sleeve 16 and ring 18 so as to be rotatable about but not movable along longitudinal axis 12. Accordingly, sleeve 16 and ring 18 act as a bearing means for sleeve 20. A pair of transversely opposed and apertured lugs 22 are integrally connected to and laterally extend from sleeve 20, thereby being adjacent to but longitudinally offset from lugs 14. As shown, sleeves 16 and 20, and associated respective lugs 14 and 22, are more closely adjacent to the upper end than the lower end of tubular member 10.

Sleeves 24 and 26, and associated respective lugs 28 and 30, are similar to sleeves 16 and 20 and associated respective lugs 14 and 22, except for being more closely adjacent to the lower end than the upper end of tubular member 10. The pair of transversely opposed and apertured lugs 28 are integrally connected to and laterally extend from sleeve 24, which is integrally connected to tubular 10. Therefore, lugs 28 are integrally connected to and laterally extend from tubular member 10 by means of sleeve 24. Ring 32 is also integrally connected to tubular member 10. Sleeve 26 is rotatably connected to tubular member 10, and is closely received between sleeve 24 and ring 32 so as to be rotatable about but not movable along longitudinal axis 12. Accordingly, sleeve 24 and ring 32 act as a bearing means for sleeve 26. A pair of transversely opposed and apertured lugs 30 are integrally connected to and laterally extend from sleeve 26, thereby being adjacent to but longitudinally offset from lugs 28.

Figure 2:
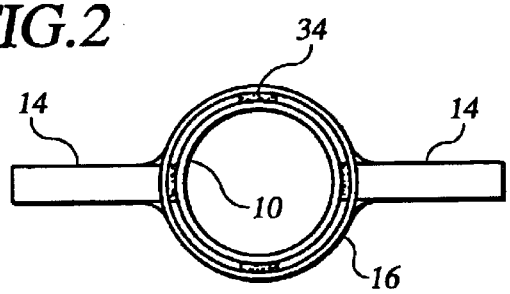
FIG. 2 is a top view of the combination of FIG. 1 as viewed along line 2—2.

Referring to FIG. 2, this top view shows welds 34 that integrally connect sleeve 16 to tubular member 10, as well as lugs 14 laterally extending from sleeve 16. Tubular member 10 is coaxial with sleeve 16.

Figure 3:
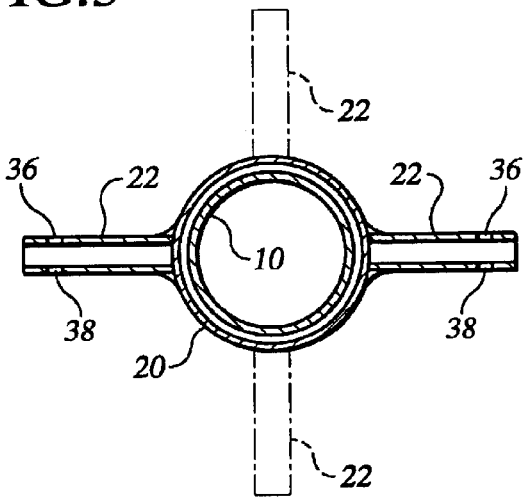
FIG. 3 is a cross-sectional view of the combination of FIG. 1 as viewed along line 3—3.

Referring to FIG. 3, this cross-sectional view shows coaxial tubular member 10 and sleeve 20, as well as lugs 22 laterally extending from sleeve 20. Each lug 22 (as well as each of the other lugs) is preferably comprised of square tube stock, and has a pair of aligned apertures 36 and 38 through opposing side walls of the lug. As discussed above, sleeve 20 is rotatable with respect to tubular member 10. Accordingly, sleeve 20 and associated lugs 22 can be rotated to any desired rotational position, such as a 90° rotation from that position in solid lines to that position shown in phantom lines.

Of course, all features discussed with reference to FIGS. 2 and 3, in regard to sleeves 16 and 20 and associated respective lugs 14 and 22, also apply to sleeves 24 and 26 and associated lugs 28 and 30.

Figure 4:
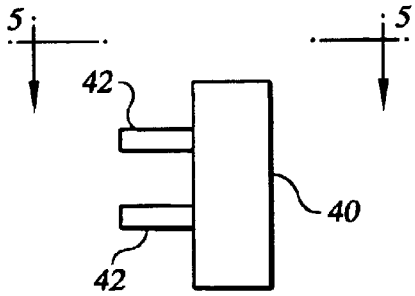
FIG. 4 is a side view of a tubular member shorter in length than the tubular member of FIG. 1 and having a pair of lugs integrally connected thereto.

Referring to FIG. 4, tubular member 40 preferably has a diameter similar to tubular member 10, but is shorter in length than tubular member 10. Tubular member 40 has opposing upper and lower ends which are open. A pair of lugs 42, having the same structure as the lugs associated with the sleeves of tubular member 10, are integrally connected to and laterally extend from tubular member 40. In addition, lugs 42 are longitudinally offset from one another and approximately coplanar.

Figure 5:
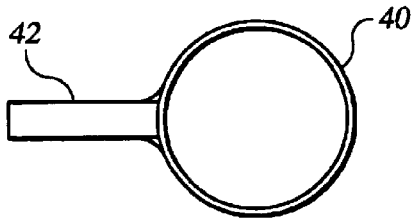
FIG. 5 is a top view of the tubular member and associated lugs of FIG. 4 as viewed along line 5—5.

Referring to FIG. 5, this top view shows tubular member 40 and the upper lug 42 laterally extending therefrom.

Figure 6:
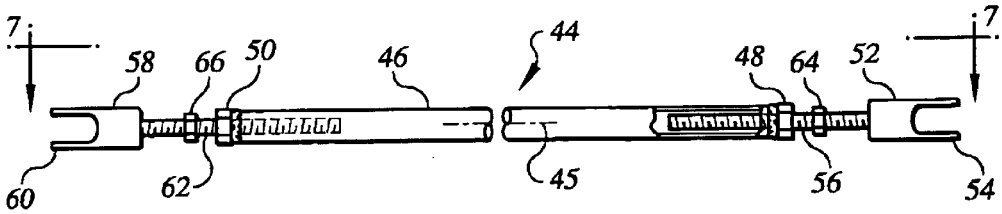
FIGS. 6 and 7 are different views of a brace and associated connectors at each end.

Referring to FIG. 6, brace 44 has a longitudinal axis 45 and preferably comprises a tubular body 46 and opposing, internally threaded ends 48 and 50, most conveniently formed by nuts integrally connected to the tubular body. A first connector 52 has a forked end portion 54 and an opposing, elongated end portion 56 that is threaded. End portion 56 is threadedly received by end 48 of brace 44. The wall of a portion of tubular body 46 is broken away to reveal a part of end portion 56 received inside the tubular body. A second connector 58 is similar to connector 52 in having a forked end portion 60 and an opposing, elongated end portion 62 that is threaded. End portion 62 is threadedly received by end 50 of brace 44. The position of each connector relative to the corresponding end of brace 44 is longitudinally adjustable by rotation of the connector while brace 44 remains fixed, or by rotation of brace 44 while the connector remains rotationally fixed. FIG. 6 further shows that end portions 56 and 62 are oppositely threaded. This feature allows longitudinal adjustment with respect to both connectors simultaneously by rotation of brace 44 while both connectors remain rotationally fixed. After completion of any longitudinal adjustment, nuts 64 and 66 (as threadedly received on respective end portions 56 and 62) can be tightened against ends 48 and 50 of brace 44.

Figure 7:
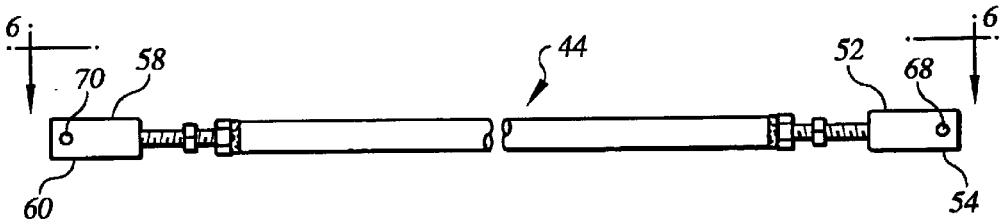

Referring to FIG. 7, this view of brace 44 and associated connectors 52 and 58 shows one of two aligned apertures 68 in end portion 54, and also shows one of two aligned apertures 70 in end portion 60. End portions 54 and 60 will sometimes be referred to hereafter as apertured end portions.

Figure 8:
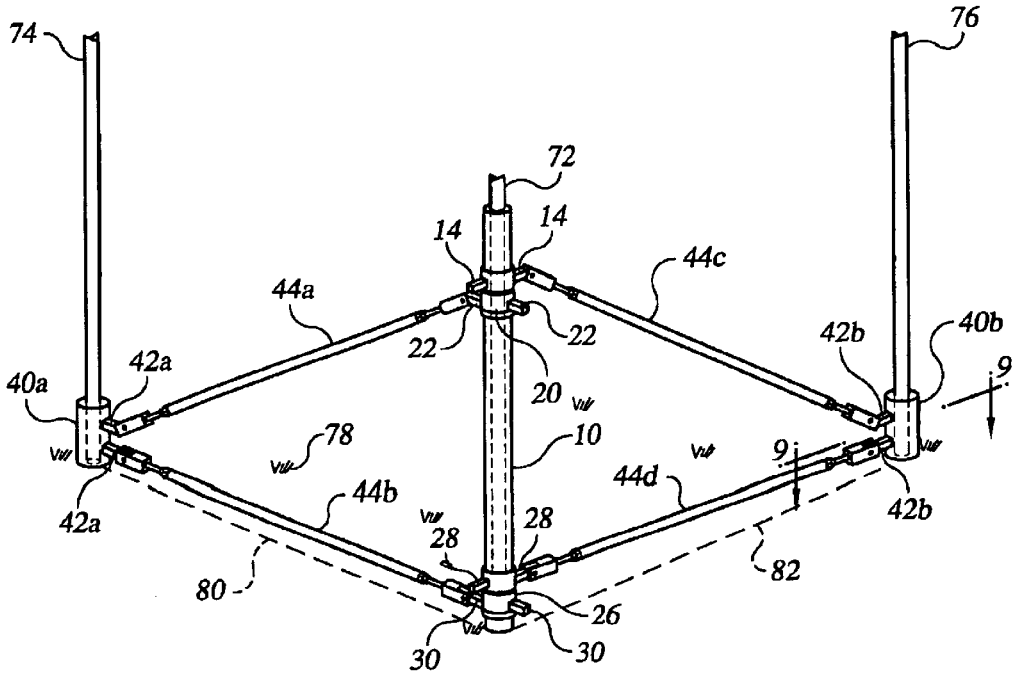
FIG. 8 is a perspective view of one embodiment of a fence assembly in accordance with the invention.

It will be apparent from FIG. 8 and the following discussion that the length of brace 44 will depend upon whether it will be used to extend straight across between tubular members or between upper and lower positions (i.e. diagonal).

Referring to FIG. 8, the illustrated fence assembly includes fence posts 72, 74, and 76 extending upwardly from the ground 78. Each of the fence posts is preferably a T-post. Tubular member 10 is received over but not connected to fence post 72 such the lower end of tubular member 10 rests upon the ground. Tubular members 40*a* and 40*b* are respectively received over fence posts 74 and 76 such that the lower ends of such tubular members also rest upon the ground. The fence posts and associated tubular members are arranged in a corner post configuration in the embodiment of FIG. 8. As shown, sleeves 20 and 26 are rotationally positioned such that lugs 22 and 30 are substantially perpendicular to lugs 14 and 28. Of course, sleeves 20 and 26 can be rotated to position lugs 22 and 30 in any desired angular relationship to lugs 14 and 28. Lugs 42*a* are shown as being adjacent to a line 80 defined by the lower end of tubular member 40*a* and the lower end of tubular member 10. Similarly, lugs 42*b* are adjacent to a line 82 defined by the lower end of tubular member 40*b* and the lower end of tubular member 10.

Brace 44*a* has one end removably connected to one of lugs 22 and the other end removably connected to the upper lug 42*a*. Brace 44*b* has one end removably connected to one of lugs 30 and the other end removably connected to the lower lug 42*a*. Brace 44*c* has one end removably connected to one of lugs 14 and the other lug removably connected to the upper lug 42*b*. Brace 44*d* has one end removably connected to one of lugs 28 and the other end removably connected to the lower lug 42*b*. The latter removable connection is shown in FIG. 9, and is understood to be representative of the other above-mentioned connections.

Figure 9:
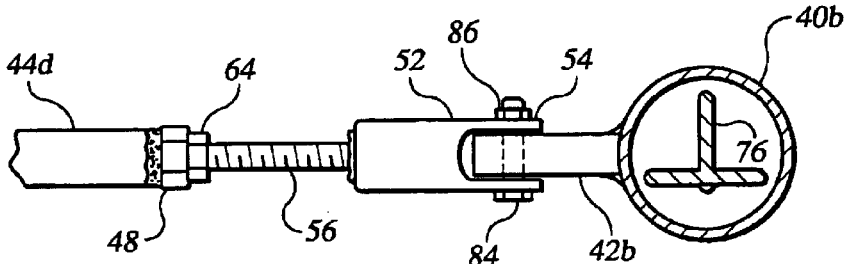
FIG. 9 is a view of one end of a brace in FIG. 8, as viewed along line 9—9, as removably connected with a connector to a lug of a tubular member.

Referring to FIG. 9, fence post 76 (a T-post) and tubular member 40*b* are shown in cross section. Lower lug 42*b* laterally extends from tubular member 40*b*. The shaft of a bolt 84 is received through aligned apertures (see FIGS. 4 and 7) of lower lug 42*b* and end portion 54 of connector 52. A nut 86 is threadedly received on the end of bolt 84 to secure the bolt in place. A pivotal and removable connection of end portion 54 to lower lug 42*b* is thereby provided. Also shown in FIG. 9 is end portion 56 of connector 52 as threadedly received by end 48 of brace 44*d*. Nut 64 is tightened against end 48 to thereby serve as a jam nut.

Installation of the fence assembly is quick and easy, even on uneven terrain. The fence posts (T-posts) are first driven into the ground in the usual manner at locations approximated by the installer. The tubular members are then slipped over corresponding fence posts. To install a brace, the installer can hold the brace and rotate one or both of the opposing connectors to approximate the desired distance between their apertured end portions. The apertured end portion of one connector is then connected to a first lug with a bolt and nut. The brace is pivoted to the appropriate height and rotated in the appropriate direction until the apertures of the apertured end portion of the other connector are aligned with the apertures of a second lug. A bolt is passed through the aligned apertures and a nut threaded onto the bolt to connect the latter mentioned apertured end portion to the second lug. Final adjustments can be made by rotating the brace (i.e. with a pipe wrench) in the appropriate direction, as is made possible with the opposite threads of the connectors discussed above.

Although the fence assembly has been illustrated and described in terms of a corner post configuration, many other configurations are possible in accordance with the invention, including but not limited to: linear alignment of the fence posts and their corresponding tubular members; addition of another fence post and tubular member to form a configuration in the shape of a "T"; and addition of yet another fence post and tubular member to form a cross-fence configuration, in which case all lugs associated with sleeves of tubular member 10 would be used. In any configuration, wire (not shown) in a finished fence can simply be wrapped around tubular member 10 to secure the wire thereto.

Figure 10:
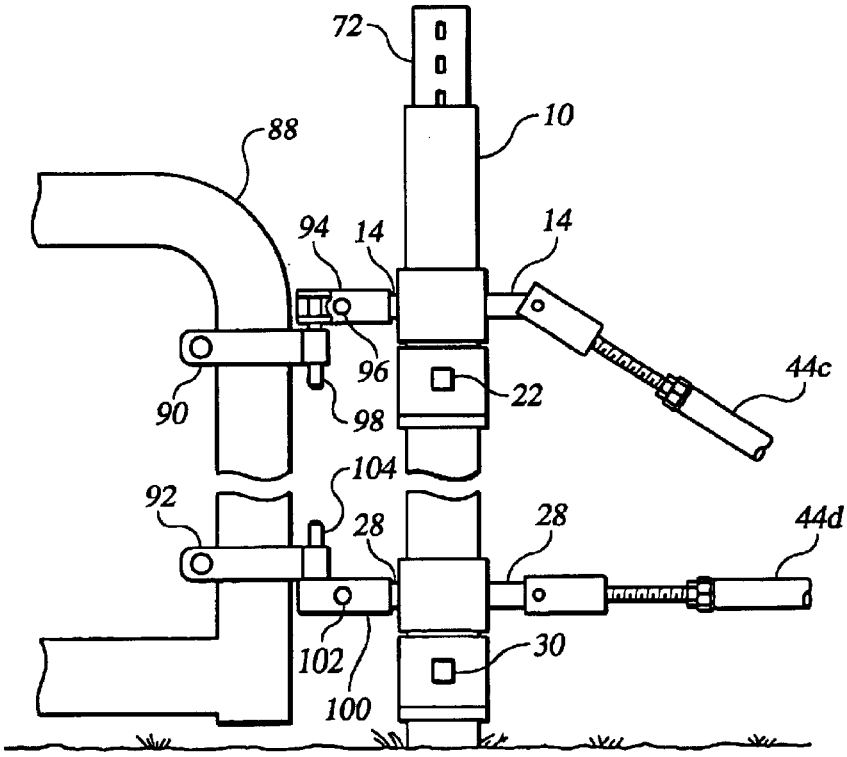
FIG. 10 shows the manner in which a gate can be pivotally connected to lugs extending from the tubular member of FIG. 1, with the aid of novel brackets received over the lugs.

Referring to FIG. 10, a gate 88 is shown as being hung on tubular member 10 with the lugs 14 and 28 that are unused in the fence assembly of FIG. 8. Only the upper and lower ends of gate 88 are shown, with the middle portion broken away. A middle portion of tubular 10 is also broken away in FIG. 10. A gate bracket 90 is mounted to gate 88 more closely adjacent to its upper end than its lower end. A gate bracket 92 is mounted to gate 88 more closely adjacent to its lower end than its upper end. An apertured hinge bracket 94 is received over one of lugs 14 so that the apertures of hinge bracket 94 are aligned with the apertures of lug 14. A bolt 96 is received through the aligned apertures and secured in place with a nut (not visible in FIG. 10) to thereby fixedly but removably connect hinge bracket 94 to lug 14. Hinge bracket 94 has a stud 98 transversely extending from the free end of the hinge bracket. As shown (with a portion of one wall of hinge bracket 94 broken away), one end of stud 98 is received in hinge bracket 94 and is further integrally connected to the interior surface thereof. Stud 98 is received through a portion of gate bracket 90 to provide a pivotal connection to the gate bracket. A hinge bracket 100, similar in structure to hinge bracket 94 but oppositely oriented, is fixedly but removably connected to one of lugs 28 with a bolt 102, and has a stud 104 received through a portion of gate bracket 92 to pivotally connect hinge bracket 100 to the gate bracket. The other lugs 14 and 28 are removably connected to ends of braces 44*c* and 44*d*, respectively, with associated connectors in the manner previously described.

Obviously, many modifications and variations of the present invention are possible in light of the above teachings. For example, only one connector at one end of a brace could have an elongated end portion that is threaded, whereas the connector at the other end of the brace could be connected to that end with a swivel to allow free rotation. Or, each of the connectors at respective ends of a brace could have an elongated end portion that is unthreaded but telescopically received by an end of the brace to thereby enable longitudinal adjustment. It is, therefore, to be understood that within the scope of the appended claims the invention can be practiced otherwise than as specifically described.

That which is claimed is:

1. A fence assembly comprising:

a first fence post extending upwardly from the ground;

a first tubular member having a first upper end and a first lower end, the first tubular member being received over but not connected to the first fence post such that the first lower end rests upon the ground;

a first lug laterally extending from the first tubular member;

a second fence post extending upwardly from the ground;

a second tubular member having a second upper end and a second lower end, the second tubular member being received over but not connected to the second fence post such that the second lower end rests upon the ground;

a second lug laterally extending from the second tubular member;

a brace having opposing ends;

a first connection means for removably connecting one end of the brace to the first lug; and a second connection means for removably connecting the other end of the brace to the second lugs.

2. A fence assembly as recited in claim 1 wherein the brace has a longitudinal axis extending between the opposing ends.

3. A fence assembly comprising:

a first fence post extending upwardly from the ground;

a first tubular member having a first upper end and a first lower end, the first tubular member being received over but not connected to the first fence post such that the first lower end rests upon the ground;

a first lug laterally extending from the first tubular member;

a second fence post extending upwardly from the ground;

a second tubular member having a second upper end and a second lower end, the second tubular member being received over but not connected to the second fence post such that the second lower end rests upon the ground;

a second lug laterally extending from the second tubular member;

a first brace having opposing ends;

a first connection means for removably connecting one end of the first brace to the first lug; and a second connection means for removably connecting the other end of the first brace to the second lug;

a third lug laterally extending from the first tubular member;

a fourth lug laterally extending from the second tubular member;

a second brace having opposing ends;

a third connection means for removably connecting one end of the second brace to the third lug; and a fourth connection means for removably connecting the other end of the second brace to the fourth lug;

wherein the first lug is more closely adjacent to the first upper end than the first lower end, the third lug is more closely adjacent to the first lower end than the first upper end, and the second and fourth lugs are adjacent to a line defined by the first and second lower ends.

4. A fence assembly as recited in claim 3 further comprising: a third fence post extending upwardly from the ground; a third tubular member having a third upper end and a third lower end, the third tubular member being received over but not connected to the third fence post such that the third lower end rests upon the ground; a fifth lug laterally extending from the first tubular member; a sixth lug laterally extending from the third tubular member; a third brace having opposing ends; a fifth connection means for removably connecting one end of the third brace to the fifth lug; a sixth connection means for removably connecting the other end of the third brace to the sixth lug; a seventh lug laterally extending from the first tubular member; an eighth lug laterally extending from the third tubular member; a fourth brace having opposing ends; a seventh connection means for removably connecting one end of the fourth brace to the seventh lug; and an eighth connection means for removably connecting the other end of the fourth brace to the eighth lug; wherein the fifth lug is more closely adjacent to the first upper end than the first lower end, the seventh lug is more closely adjacent to the first lower end than the first upper end, and the sixth and eighth lugs are adjacent to a line defined by the first and third lower ends.

5. A fence assembly as recited in claim 4 wherein the first tubular member has a longitudinal axis, and wherein the first and third lugs comprise a first pair of lugs and the fifth and seventh lugs comprise a second pair of lugs, and further wherein each of one pair of lugs is integrally connected to the first tubular member and each of the other pair of lugs is rotatably connected to the first tubular member so as to be rotatable about but not movable along the longitudinal axis when not connected to their corresponding braces.

6. A fence assembly as recited in claim 4 wherein each lug has at least one aperture therethrough and each brace has a longitudinal axis, and wherein each connection means for removably connecting an end of a brace to a lug comprises: a connector having an apertured first end portion with at least one aperture adapted for alignment with said at least one aperture of a corresponding lug, the connector also having an opposing, elongated second end portion adapted for longitudinally adjustable connection to the end of a corresponding brace; and at least one fastener having a shaft for being received through aligned apertures of the corresponding lug and the first end portion to thereby provide a pivotal and removable connection of the first end portion to the corresponding lug.

7. A fence assembly as recited in claim 6 wherein the second end portion of each connector means is threadedly receivable by the end of a corresponding brace.

8. A fence assembly as recited in claim 7 wherein second end portions as connected to opposing ends of each brace are oppositely threaded.

9. A fence assembly as recited in claim 4 further comprising: a ninth lug laterally extending from the first tubular member more closely adjacent to the first upper end than the first lower end; a tenth lug laterally extending from the first tubular member more closely adjacent to the first lower end that the first upper end; a gate having a gate upper end and a gate lower end, and also having a first gate bracket more closely adjacent to the gate upper end than the gate lower end and a second gate bracket more closely adjacent to the gate lower end that the gate upper end; a first hinge bracket for being fixedly but removably connected to the ninth lug and a second hinge bracket for being fixedly but removably connected to the tenth lug, the first hinge bracket being adapted for pivotal connection to the first gate bracket and the second hinge bracket being adapted for pivotal connection to the second gate bracket.

10. A fence assembly as recited in claim 4 wherein each fence post is a T-post.

11. A fence assembly as recited in claim 4 wherein the second and third tubular members are shorter in length than the first tubular member.

12. A fence assembly as recited in claim 4 wherein the upper and lower ends of each tubular member are open.

13. A combination comprising:

a tubular member having a longitudinal axis and opposing first and second ends;

a first sleeve rotatably connected to the tubular member so as to be rotatable about but not movable along the longitudinal axis, the first sleeve being more closely adjacent to the first end than the second end;

a first bearing means integrally connected to the tubular member for allowing rotation of the first sleeve about but not movement along the longitudinal axis;

a pair of transversely opposed and apertured first lugs integrally connected to and laterally extending from the first sleeve;

a second sleeve rotatably connected to the tubular member so as to be rotatable about but not movable along the longitudinal axis, the second sleeve being more closely adjacent to the second end than the first end;

a second bearing means integrally connected to the tubular member for allowing rotation of the second sleeve about but not movement along the longitudinal axis;

a pair of transversely opposed and apertured second lugs integrally connected to and laterally extending from the second sleeve;

a pair of transversely opposed and apertured third lugs integrally connected to and laterally extending from the tubular member adjacent to the first sleeve and associated first lugs, the third lugs as adjacent to the first lugs being longitudinally offset therefrom and also more closely adjacent to the first end than the second end; and a pair of transversely opposed and apertured fourth lugs integrally connected to and laterally extending from the tubular member adjacent to the second sleeve and associated second lugs, the fourth lugs as adjacent to the second lugs being longitudinally offset therefrom and also more closely adjacent to the second end than the first end.

14. A combination as recited in claim 13 wherein the first bearing means comprises a first ring integrally connected to the tubular member and a third sleeve integrally connected to the tubular member and having the third lugs integrally connected thereto and laterally extending therefrom so that the third lugs are integrally connected to and laterally extend from the tubular member by means of the third sleeve, the first sleeve being closely received between the first ring and third sleeve, and wherein the second bearing means comprises a second ring integrally connected to the tubular member and a fourth sleeve integrally connected to the tubular member and having the fourth lugs integrally connected thereto and laterally extending therefrom so that the fourth ligs are integrally connected to and laterally extend from the tubular members by means of the fourth sleeve, the second sleeve being closely received between the second ring and fourth sleeve.

* * * * *